US008297863B2

(12) United States Patent
Campanini

(10) Patent No.: US 8,297,863 B2
(45) Date of Patent: Oct. 30, 2012

(54) PRINTING ROLL RELEASE MECHANISM

(75) Inventor: Alberto Campanini, Fidenza (IT)

(73) Assignee: Custom Engineering S.p.A. (IT)

( * ) Notice: Subject to any disclaimer, the term of this patent is extended or adjusted under 35 U.S.C. 154(b) by 768 days.

(21) Appl. No.: 12/321,216

(22) Filed: Jan. 20, 2009

(65) Prior Publication Data

US 2009/0196671 A1 Aug. 6, 2009

(30) Foreign Application Priority Data

Jan. 29, 2008 (EP) ..... 08425042

(51) Int. Cl.
*B41J 15/00* (2006.01)

(52) U.S. Cl. ..... 400/619

(58) Field of Classification Search ..... 400/619
See application file for complete search history.

(56) References Cited

U.S. PATENT DOCUMENTS

| | | | | |
|---|---|---|---|---|
| 5,201,588 | A * | 4/1993 | Sakai et al. | 400/613 |
| 5,594,486 | A | 1/1997 | Kiyohara | |
| 6,789,969 | B2 * | 9/2004 | Hirabayashi et al. | 400/693 |
| 2006/0210341 | A1 | 9/2006 | Naito | |

FOREIGN PATENT DOCUMENTS

| | | | |
|---|---|---|---|
| EP | 1702759 | | 9/2006 |
| JP | 2006256139 | A | 9/2006 |
| KR | 20060101250 | A | 9/2006 |

* cited by examiner

*Primary Examiner* — Michael G Lee
*Assistant Examiner* — Matthew Mikels
(74) *Attorney, Agent, or Firm* — Laubscher & Laubscher, P.C.

(57) ABSTRACT

A printing roll release and retainer mechanism to facilitate the insertion of a printing roller into a printing head of a thermal printer and to facilitate the locking thereof to the printing head and to facilitate the removal of the printing roller from the printing head wherein a holder is provided for receiving and permitting withdrawal of the printing roller and a pair of oppositely spaced members is provided for to hold the shaft roller.

A locking-release member is provided for the holder to facilitate locking of the roller to the printing head and removal therefrom, the oppositely spaced members have an arcuate configuration for receiving the shaft and is provided with a pair of portions extending from the ends of the arcuate configuration, the locking release member include spaced members with an arcuate configuration for receiving the shaft when the roller is inserted into the head, and a pair of members are provided for locking the roller to the printing head in one position of the locking-release member and for releasing the roller from the head in another position of the locking-release member.

17 Claims, 6 Drawing Sheets

PRINTING ROLL RELEASE MECHANISM

FIELD OF THE INVENTION

This invention is concerned with a printing roll release mechanism for a thermal printer. More particularly, the present invention is concerned with a mechanical arrangement that provides for easy removal and insertion of a printing roll, preferably a gummed printing roll from and into the thermal printer which includes the printing roll release of the head in the thermal printer.

DESCRIPTION OF THE PRIOR ART

In present day thermal printers, the printing roll is fastened to a support apparatus that permits the gummed printing roll to rotate around its own longitudinal axis. In known thermal printer apparatus, difficulties arise in connection with the pulling out or removal of the gummed printing roll from the printer apparatus, as well as difficulties in connection with insertion of the gummed printing roll into the thermal printer apparatus.

BRIEF SUMMARY OF THE INVENTION

One of the features of the present invention is to provide an arrangement to enable the removal or freeing of the gummed printing roll from its seating arrangement in the thermal printer with ease and rapidity of time.

For this purpose, freeing levers are provided which are actuated by means of a freeing or release tooth which cooperates with and acts on pins and ferrules forming part of or associated with the gummed printing roll.

One of the purposes of the present invention is to provide an arrangement to easily free the printing roll from its own seat and with greater rapidity by activating release or freeing levers which levers can be easily moved and used by any user and with the assistance of freeing tooth pins and ferrules which activates associated work of the printing roll.

LIST OF REFERENCE NUMERALS

1. holder for the printing head
2. upper openings in the upper part of the printing head
3. ferrule
4. washer
5. shaft
6. gummed printing roll
7. semicircular cavity provided in opening 2
8. first extension forming slanting part toward the upper opening 2
9. projection or vertical part
10. projection part of semicircular cavity 7
11. holes on holder 1
12. pin or shaft
13. release and locking lever rotatable around pin 12
14. locking teeth provided on lever 13
15. freeing or release teeth provided on lever 13 for printing roll 6
16. semicircular cavity
17. outline of inside surface
18. portion defining an outline projection
19. projection part rotates about shaft 12

DETAILED SUMMARY OF THE INVENTION

To these ends, the invention consists in the provision of a printing roll release mechanism for a printing head in a thermal printer comprising a holder 1 for the printing head provided with upper openings 2, a pair of oppositely disposed semi-circular cavities 7, each of the upper openings being extended from one end of the semi-circular cavity providing an outline having inside part comprising a semi-circular cavity 7, a slanting part (8) extending from one end of each of the semi-circular cavities toward the upper opening 2 and a vertical part 9 extending from the other end of each of the semi-circular cavities, a lever 13 provided with a pair of opposing semi-circular cavities 16 which include locking teeth 14 and freeing teeth 15 to cooperate with the gummed printing roll, and the opposing semi-circular cavities 7 for the openings 2 of the holder 1 which cooperate with the semi-circular cavities 16 of the lever 3 and with the locking teeth 14 to fasten the printing roll 6 in its working position, and a lifting projection part 19 coupled with the lever 13 for rotating the lever around a pin 12 for controlling and permitting of a freeing of the gummed printing roll 6 for lifting the printing roll 6 from its seat by means of the freeing teeth 15 that push the ferrules (3) and the printing roll (6) along slanting part 8 of the openings 2 of the holder 1.

The invention is further concerned with printer which includes a holder 1 for holding the printing roll (6), each of the upper openings in the holder is provided with an outline having an inside part comprising a first semi-circular cavity 7 including two terminal ends, a slanting part 8 extending from the first terminal end of the semi-circular cavity toward the upper opening the upper opening 2 and a first vertical part 9 extending from the slanting part 8 and a second vertical part 10 extending from the other terminal end of the semi-circular cavity, a locking lever 13 including a second or another set of semi-circular cavities 16 provided with locking teeth 14 and freeing teeth 15 to cooperate with the printing roll 6 for locking and releasing the printing roll from the thermal printer, in the first-mentioned semi-circular cavities 7 cooperating with the second-mentioned semi-circular cavities 16 and the locking teeth 14 fastening the printing roll 6 in its working position, and a lifting projection part 19 is coupled with the lever 13 for rotating the lever 13 around a pin 12 to free the printing roll 6 from the holder 1 so that the printing roll 6 can be lifted from its seat, and the freeing teeth 15 push the ferrules 3 and the printing roll 6 along the slanting parts 8 of the openings 2.

The upper openings are spaced and oppositely disposed. The slanting part 8 and the vertical part 9 form an obtuse angle therebetween to permit the ferrule to slide out of the semi-circular portion 7.

The printing roll is carried on a shaft 5 having a longitudinal axis and is substantially perpendicular to the vertical part 9 when the shaft 5 is sealed in its seat and shaft 5 is received in the openings 2.

The second vertical part 10 extends from the second terminal end of the first-mentioned semi-circular cavity 7 and is substantially parallel to the first vertical part 9 and together form a guideway for the ferrule 3.

The slanting part 8 and the first vertical part 9 form one side of the guideway for the ferrule 3 and the second vertical part 10 forms the other side of the guideway.

The locking teeth 14 and 15 together with the second-mentioned semi-circular cavity 16 form a pathway therebetween for the ferrule 3. The freeing tooth 15 is provided on the innermost part of the release and locking lever 13 with an inside surface 17 having an outline which extends from one end of the semi-circular cavity 16 to its other end 18 proximate to the locking tooth 14 and is a partial continuation of said semi-circular cavity.

The semi-circular cavity 16 has another end which is provided with a portion defining an outline projection 18 forming a substantially S-shaped curvature such that a substantially central area where the S-shaped portion changes direction, portion 18 acts as a part of locking member together with the locking tooth 14 to lock shaft 5 to the release and locking lever 13.

The release and locking lever includes a circular arm and two extension members each provided with one of the semi-circular cavities (16). The extension members are spaced and parallel to each other, and the projection part 19 is connected with one of said extension members and is rotatable above shaft 12. The projection part 19 is positioned at an extremity of the level 13, and the printing roll is a gummed printing roll.

The invention further consists in the provision of a printing roll release and retainer mechanism to facilitate the insertion of a printing roller into a printing head of a thermal printer and to facilitate the locking thereof to the printing head and to facilitate the removal of the printing roller form the printing head, and includes a holder for receiving and permitting withdrawal of the printing roller, the holder includes a pair of oppositely spaced receiving members, a shaft having a longitudinal axis parallel to a longitudinal axis of the printing roller, the shaft having a pair of opposed ends receivable within the oppositely spaced receiving members, a locking-release member including a mechanism operatively associated with the holder and the shaft for locking the shaft to the holder and for release of the shaft from the holder whereby to facilitate locking of the printing roller to the printing head and removal of the printing roll from the printing head, the oppositely spaced members having an arcuate configuration for receiving the longitudinal shaft and provided with a pair of extending portions extending form the ends of the arcuate configuration, the locking-release member having a pair of spaced members with an arcuate configuration for receiving the longitudinal shaft when the printing roller is inserted into the printing head, and a pair of members extending from the arcuate configuration for locking the printing roller to the printing head in one position of the locking-release member and for releasing the printing roller from the printing head in another position of the locking-release member.

Yet another feature of the thermal printer according to the invention is the provision of a printing roll release mechanism for releasing the printing roll 6 form the printing head of the thermal printer, each of the upper openings in the holder providing an outline having an inside part consisting of a semi-circular cavity 7, a slanting part 8 slanting toward the upper opening 2 and a vertical part 9, the thermal printer additionally comprising a lever 13 provided with locking teeth 14 and freeing or unlocking teeth 15 for the printing roll 6, wherein the printing roll 6 is fastened in its working position opposite to the semi-circular cavities 7 of the openings 2 and with semi-circular cavities 16 of the lever 13 and with the locking teeth 14 fastening or locking the printing roll 6 in its working position, and lifting means including a projecting part 19 coupled with the level 13 for rotation of the lever 13 around a pin 12 for a freeing of the printing roll 6 lifted from its own seat by means of the freeing teeth 15 that push the ferrules 3 of the shaft 5 of the printing roll 6 along the slanting parts 8 of the opening s 2 of the holder 1.

The semi-circular cavity 7 is provided with another vertical part 10 substantially parallel to the vertical part 9.

The following includes a list of the inventor's patents and patent applications.

U.S. Pat. No. 6,798,436, issued Sep. 28, 2004 based on U.S. patent application Ser. No. 10/147,174, filed: May 8, 2002, entitled: THERMAL PRINTER CLOSING APPARATUS U.S. Pat. No. 7,175,356, issued: Feb. 13, 2007 based on U.S. patent application Ser. No. 10/147,174 filed: May 8, 2002, entitled: HEAD SUPPORT BASE FOR THERMAL PRINTER U.S. Pat. No. 7,322,760, issued: Jan. 29, 2008 based on U.S. patent application Ser. No. 11/193,214 Filed: Jul. 29, 2005, entitled: ANTIJAMMING DEVICE FOR PRINTERS PUT IN PUBLIC PLACES U.S. patent application Ser. No. 11/272,277

| | |
|---|---|
| Publication No.: | US 2006/0152574 |
| Filed: | Nov. 10, 2005 |
| Title: | LASER WRITING HEAD FOR PRINTER |

U.S. patent application Ser. No. 11/581,770

| | |
|---|---|
| Publication No.: | US 2007/0166093 |
| Filed: | Oct. 16, 2006 |
| Title: | AUTOMATIC OPENING DEVICE FOR A PRINTER GATE |

U.S. patent application Ser. No. 11/960,956

| | |
|---|---|
| Publication No.: | US 2008/0229892 |
| Filed: | Dec. 20, 2007 |
| Title: | LIMITING DEVICE FOR ROLL PRINTER |

U.S. patent application Ser. No. 12/057,430

| | |
|---|---|
| Publication No.: | US 2008/0247799 |
| Filed: | Mar. 28, 2008 |
| Title: | THERMAL PRINTER HEAD WITH PRINT CONTROL DEVICE |

The invention together with further advantages thereof may be best understood with reference to the following description taken in connection with the accompanying drawings:

DETAILED DESCRIPTION OF THE INVENTION

Figure 4:
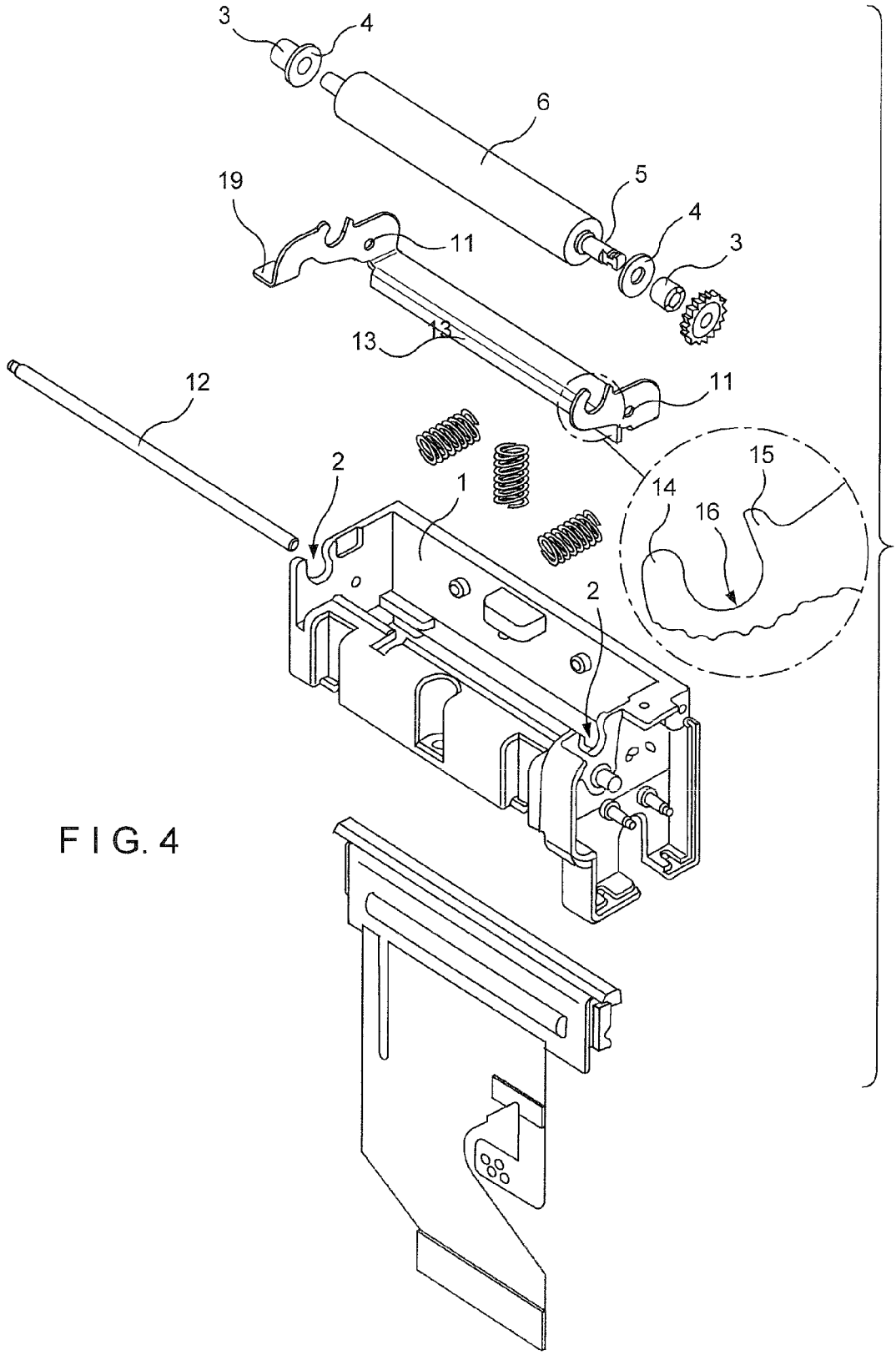
FIG. 4 is an exploded perspective view of the printing head shown in FIG. 3 and illustrating in detail the location of the insertion of the gummed printing roll.
Figure 5:
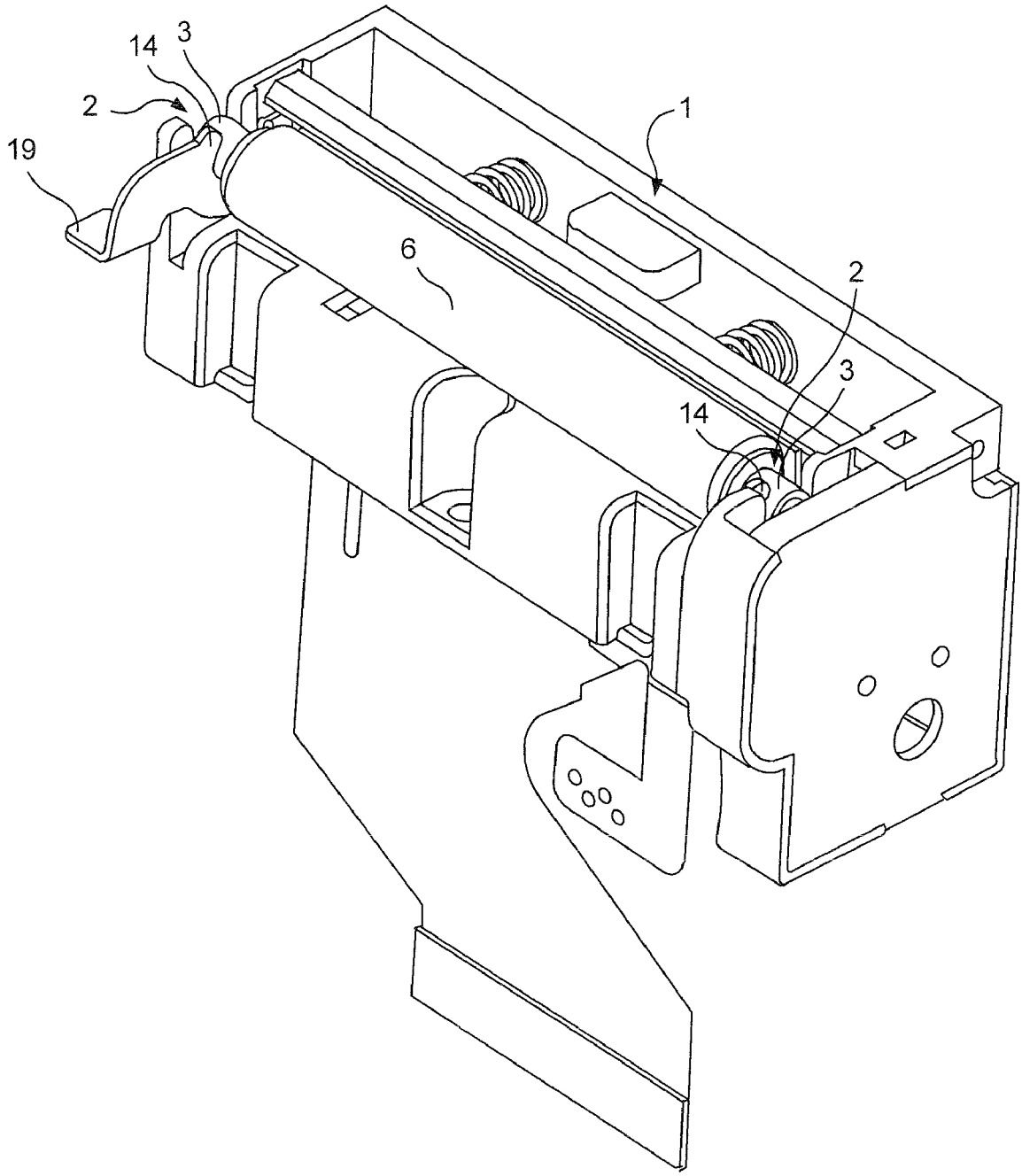
FIG. 5 is the perspective view of an assembled printing head with the printing gummed roll in a locked condition relative to the printing head.

Referring now to the accompanying drawings and, more particularly, to FIG. 5, a printing roll release mechanism according to the invention comprises printing head holder for holding gummed printing roll 6, and which is provided with a pair of oppositely disposed spaced upper openings 2 for receiving shaft 5 which carries gummed printing roll 6. As also best seen in FIG. 4, shaft 5 supports gummed printing roll 6. Positioned on each end of shaft 5 is a pair of oppositely disposed ferrules 3 and washers 4, located between each ferrule 3 and gummed printing roll 6.

Figure 6:
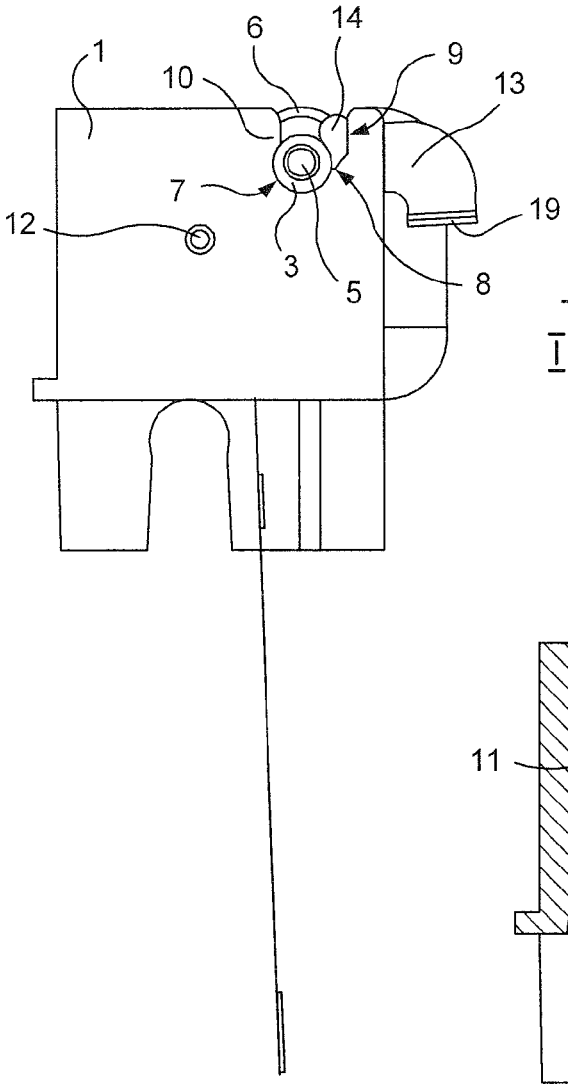
FIG. 6 is a lateral or side view of the printing head which is adapted to receive the gummed printing roll and for this purpose, there is provided an arrangement in which the printing head is provided with openings to receive a shaft which carries the gummed printing roll and is provided with a locking arrangement to maintain the shaft locked to the printing head while permitting the gummed printing roll to be freely rotatably relative to the printing head while head in the thermal printer.
Figure 7:
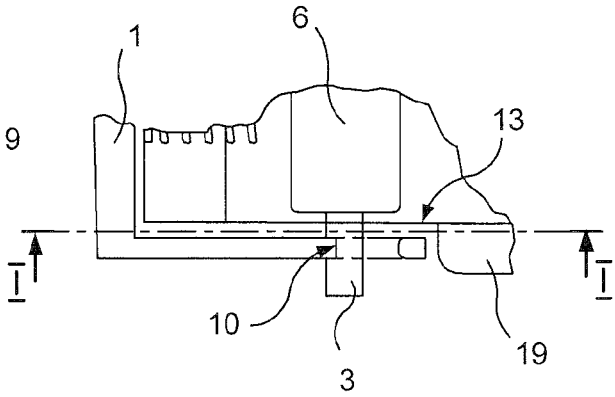
FIG. 7 is partial upper view looking down at the top of the printing head of FIG. 6 of the printing head into which the gummed printing roll is inserted in the printing head shown in FIG. 6 in same position of FIG. 6 so that the gummed printing roll can be easily released from and/or locked to the printing head.

Each upper opening 2 which receives ferrule 3, see FIG. 6, is provided with an outline having an inside part with a substantially semi-circular cavity 7, see FIG. 6. One end of semi-circular cavity 7 is provided with a first extension on projection 8 in the form of a slanting part, slanting and extending towards the upper opening 2 and a second or vertical part 9 (as shown vertically in FIG. 5) and terminating at an outer portion above first or slanting part 8. The first extension 8 extending from semi-circular cavity 7 is effectively angential to the outer surface of semi-circular cavity 8. Slanting part 8 and vertical or second projection part 9 forms an obtuse angle therebetween to permit ferrule 3 to slide out of semi-circular cavity portion 7. Shaft 5 is provided with a longitudinal axis and is received in the first projection 8 and vertical of shaft part 9 which extends in a substantially vertical direction to longitudinal axis 5.

The second or other end opposite to the one end of semi-circular cavity 7 is provided with a second projection or vertical part 10 oriented substantially perpendicular to longitudinal axis 5. The first projection or vertical part 9 is also substantially perpendicular to the longitudinal axis. First vertical or projection part 9 and second vertical or projection part 10 are substantially parallel to each other. Slanting part 8 and first or projection vertical part 9 form one side of a guide way for ferrule 3, and the second vertical or projection part 10 which is substantially parallel to first vertical or projection part 9 form the other side of the guide way to guide ferrule 3 as gummed printing roll 6 is removed from printing head holder 1.

It should also be noted that the guideway formed between first projection part 9 and second projection part 10 which also cooperates with first extension or slanting part 8 to form the guideway.

Figure 11:
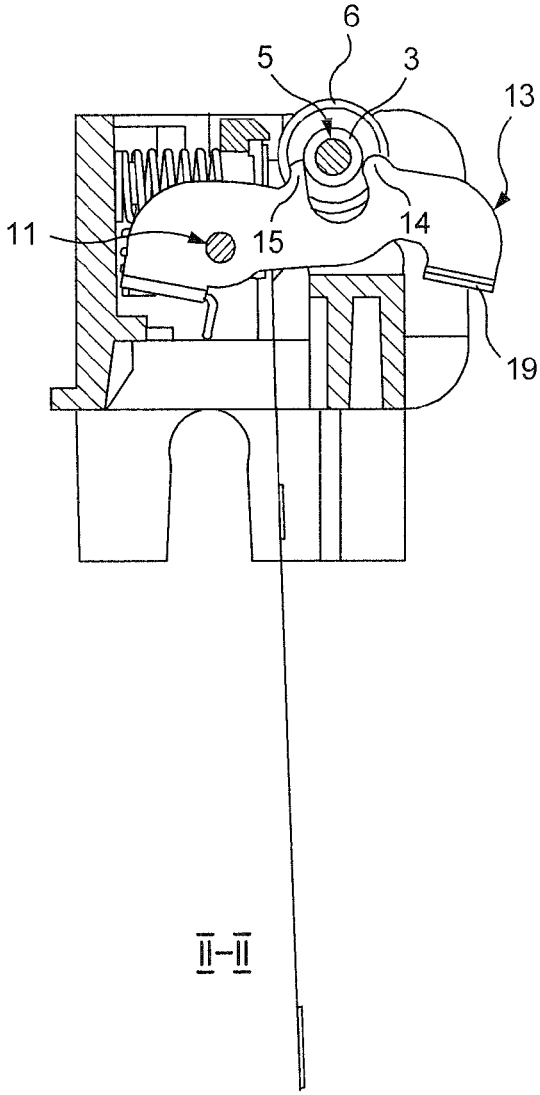
FIG. 11 is lateral sectional view taken along section line II-II of FIG. 10 illustrating the freeing or release phase of the gummed printing roll as shown from a different aspect of FIG. 10.

Referring now more particularly to FIGS. 1, 2 and 6 to 8, release and locking lever 13 is provided with a pair of oppositely spaced openings 11 for receiving pin 12 which extends through both openings 11. Lever 13 is a locking and release mechanism or lever which cooperates with gummed printing roll for releasing the gummed printing roll relative to the printing head holder. Lever 13 is provided with a pair of spaced locking teeth 15 with each locking tooth 14 positioned at opposite ends on wings extending from a central portion of lever 13, see FIGS. 5 and 11. Teeth 14 have an outer curvature which extend over and encompass a portion of the outer surface of ferrule 3 when ferrule 3 is retained and seated in a seat defined between locking teeth 14 and freeing or release teeth 15 on the wings defined by semi-circular cavity 16 and with teeth 14 and 15 extending from each side of semi-circular cavity 15 and forming a pathway for ferrule 3. The wings are also provided with the openings 11 and also include locking teeth 14 and freeing teeth 15. The semi-circular cavity 16 is provided on each wing and positioned between locking teeth 14 and freeing or release teeth 15 for receiving ferrules 3 for locking to printing head holder 1.

Semi-circular cavity 16 is suitably sized to receive ferrules 3 carried by shaft 5 of gummed printing roll 6. Each freeing or release tooth 15 is provided on the innermost part of lever 13 and is also provided with an inside surface 17, see FIG. 2, having an outline which extends from one end of semi-circular cavity 16 in a tangential direction. The other end of the semi-circular cavity 16 is provided with a portion defining a projection 18 which extends in a substantially circular direction as a continuation of the semi-circular cavity 16 to form a substantially S-shaped curvature. The other end 18 can best be defined as a partial continuation of the semi-circular cavity 16, but together with semi-circular, but together with semi-circular cavity 16 form a substantially S-shaped portion so that the substantially central area where the S-shaped portion changes direction, portion 18 acts as a locking member to lock shaft 5 to release and locking lever 13.

The cooperation of semi-circular cavity 16 and the projections 17 and 18 cooperate to provide a locking means for locking of shaft 5 carrying the gummed printing roll 6 together with the ferrules 3 to the release end locking lever 18.

Projection part 19 is provided at one end of lever 13 and positioned at an extremity for movement from a locking position to a release position for locking and removal of the gummed printing roll 6 and to permit the insertion of another gummed printing roll 6. For this purpose, projection part 19 moves the freeing or release teeth 15 from a locking position to a release position and from a release position to a locking position or condition to permit teeth 14 to engage ferrules 3 to lock shaft 5 to the release and locking lever 13.

Description of Operation

Printing roll release mechanism 9 is easily operated in the following manner from a locking phase to a release phase and again to a locking phase for locking the gummed printing roll to the printing head holder 1 of the thermal printer.

In the locking phase, the gummer printing roll 6 which is carried on longitudinal shaft 5 is locked by means of the cooperation of ferrules 3 which are received in the semi-circular cavity 16 provided on each end of lever 13. Locking teeth 14 hold ferrule 3 in place locked to locking lever 13 in a locked position when projection part 19 is moved to move lever 13 to its locking position. Ferrules 3 are also received in semi-circular cavity 7. Pin 12 is received in semi-circular opening 2 in the upper part of printing head holder 1.

For the release phase to release the gummed printing roll 6, lever 13 is activated and moved to lift by lifting projection part 19 to move ferrules 3 away from locking teeth 14.

Figure 1:
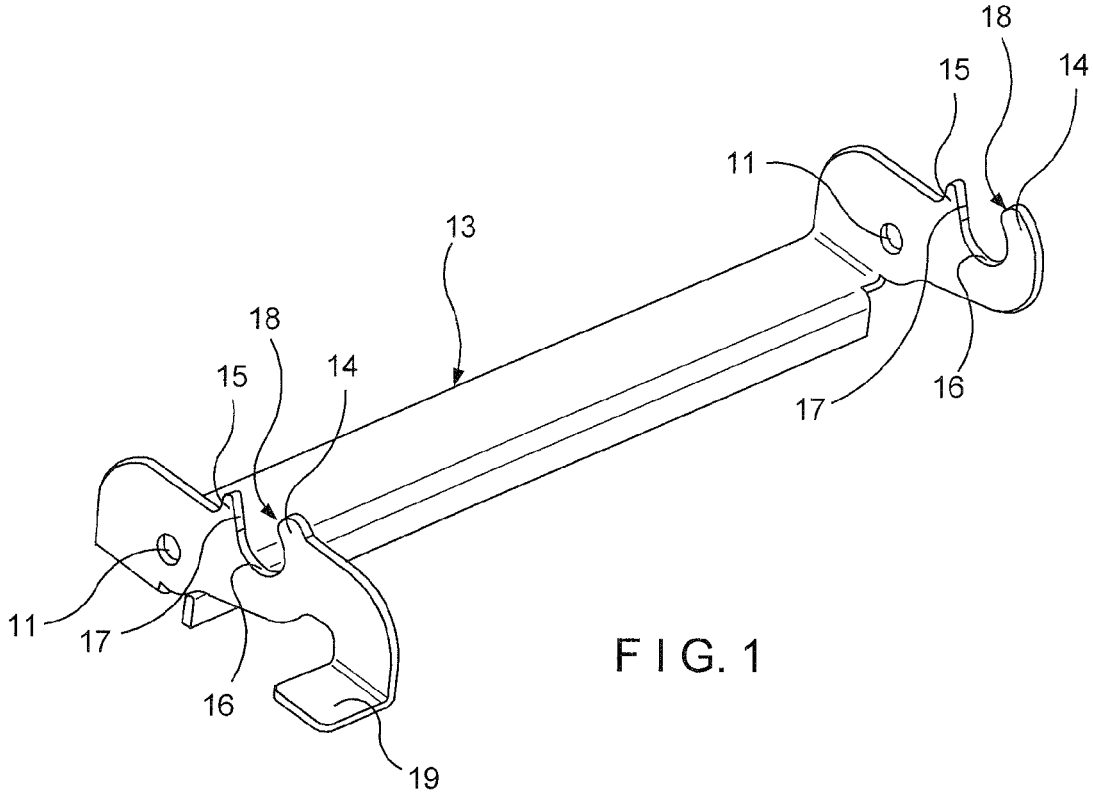
FIG. 1 is an upper perspective view of a printing roll release mechanism for a printing head forming part of a thermal printer in accordance with the invention.
Figure 2:
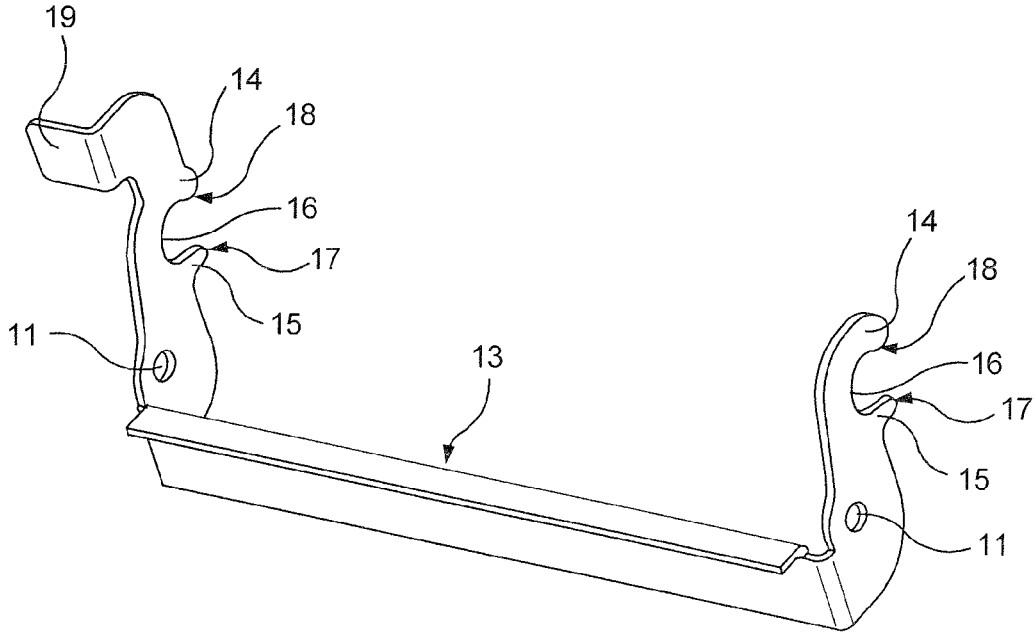
FIG. 2 is a lower perspective view of the printing roll release mechanism for the printing of FIG. 1.
Figure 3:
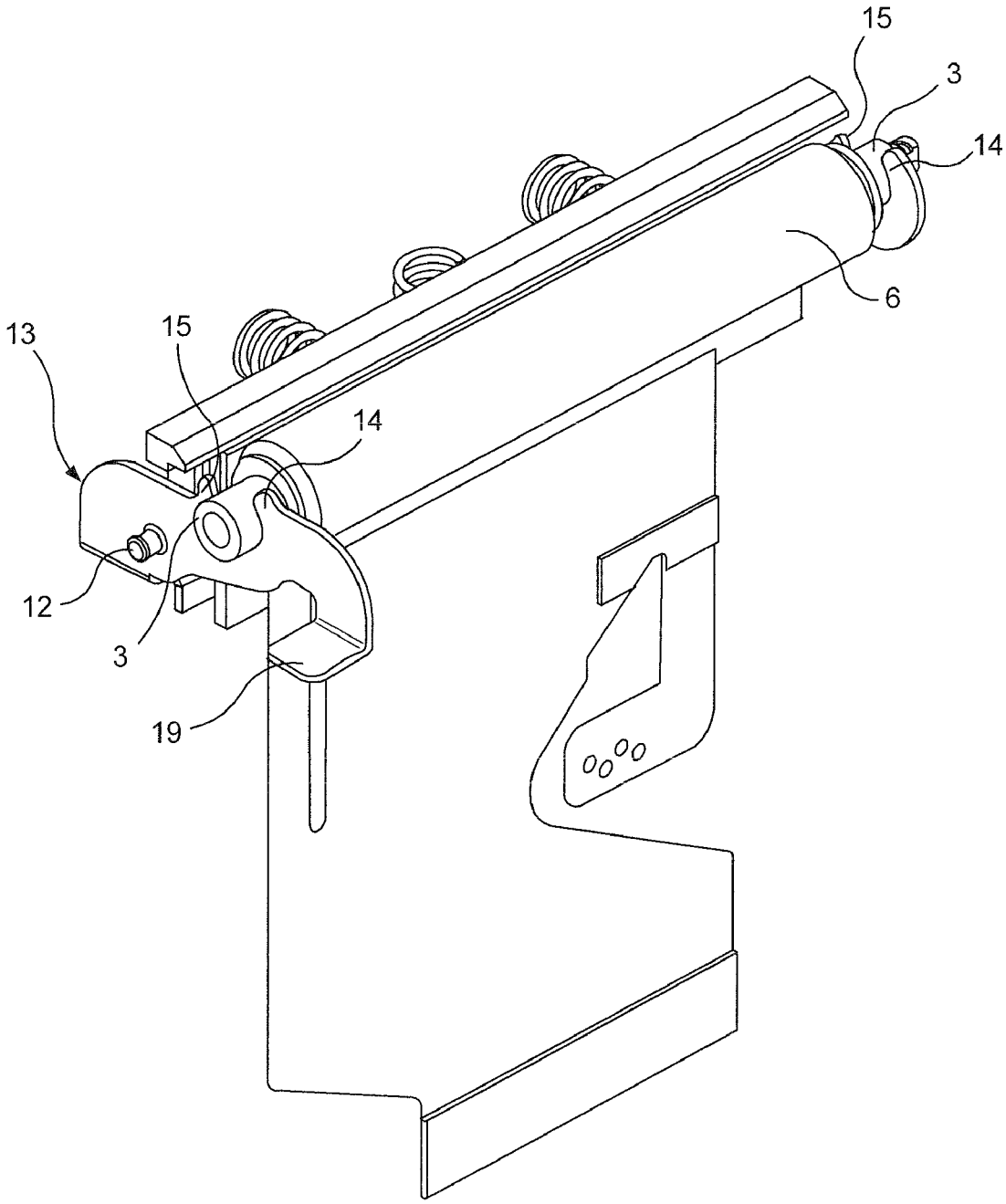
FIG. 3 is a perspective view of the gummed printing roll partially inserted into the printing head of FIG. 1.
Figure 8:
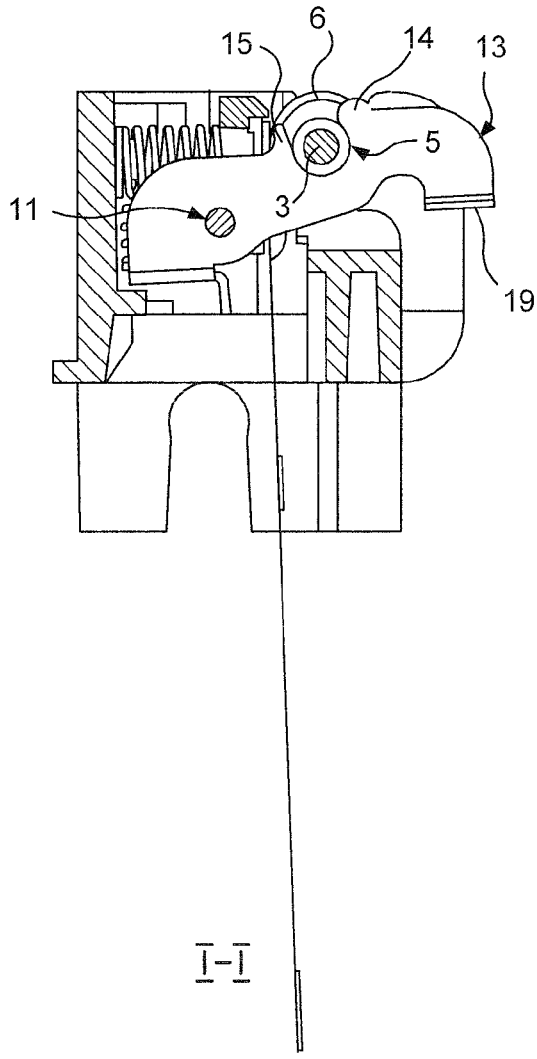
FIG. 8 is a sectioned lateral view taken in the same direction as FIG. 6 of the printing head into which the gummed printing roll is inserted in the printing head as illustrated in FIG. 6 and in the same position as shown in FIGS. 6 and 7; and, FIG. 8 is a sectional view taken along section line I-I of FIG. 7.
Figure 9:
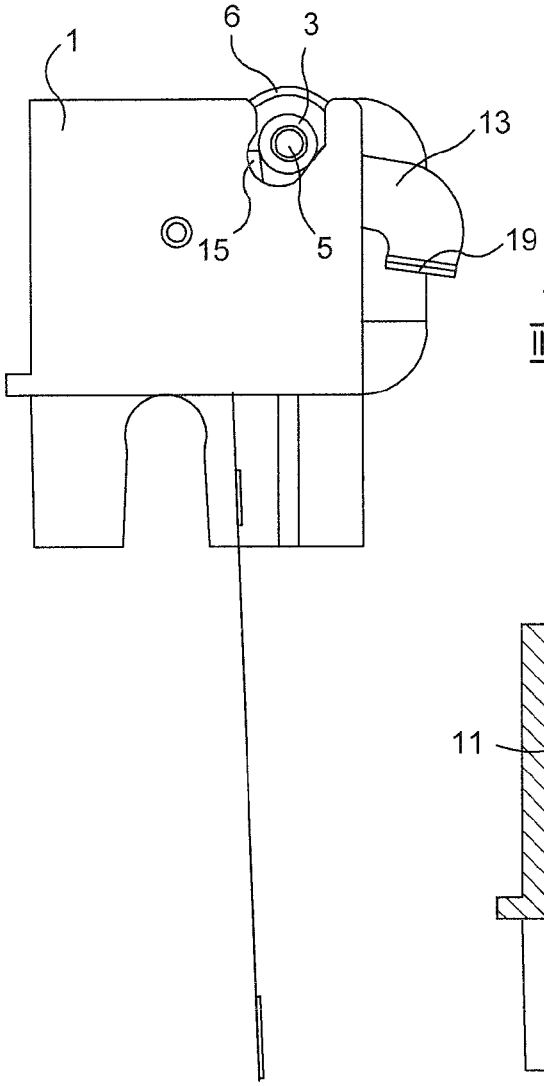
FIG. 9 is another lateral view of the printing head of FIG. 6 illustrating the freeing or release phase of the gummed printing roll for removal thereof from the printing head.
Figure 10:
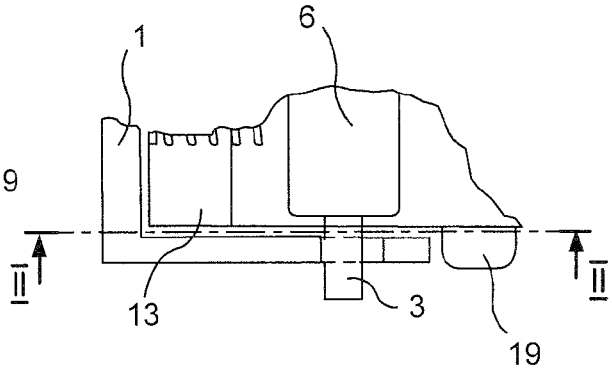
FIG. 10 is partial upper view of the printing head illustrating the freeing or release phase of the gummed printing roll.

Locking teeth 14 have a thumb-like configuration to substantially encompass ferrule 3 to lock the gummed printing roll, as best seen in FIGS. 3, 6 and 8 in the assembled and locked condition. In this position, lever 19 is shown in FIG. 3 is in a substantially horizontal position.

During operation of lever 13, blocking of ferrules 3 and shaft 5 prevent removal of the gummed printing roll 6 between the concavities formed at the opposite sides of the lever 13 with respect to the semicircular cavities 7 forming the opening 2 provided in holder 1, and the semicircular cavities 16 forming part of lever 13, with locking teeth 14 maintains printing roll 6 in the position suitable for its operation. Oppositely disposed semicircular cavities 7 and 16 cooperate together with locking teeth 14, retain gummed printing roll 6 while permitting the gummed printing roll to be free to rotate around its own longitudinal axis in the pair of ferrules 3. Ferrules 3 are maintained retained seated in opposed spaced semicircular cavities 7 and oppositely disposed semicircular cavities 16 and outlines 18 of the locking teeth 14. In the freeing or release phase of the gummed printing roll 6, lever 13 is moved by a user by the lifting of projection part 19. This motion determines and controls the rotation of the lever 13 around pin 12. By rotating the lever 13, the gummed printing roll 6 is freed from its working phase, with the freeing teeth 15 that push ferrules 3 and consequently the gummed printing roll 6 along surfaces defined by the slanting parts 8 of upper openings 2 of holder 1. At the same time and with a sole movement of locking teeth 14, semicircular cavities 16 are in such a position to permit operation of the gummed printing roll 6. In fact, semicircular cavities 7 and semicircular cavities 16 are not more opposited, with the push exercised by freeing teeth 15 that determines the lifting of the gummed printing roll 6 facilitating easy removal of the gummed printing roll. This feature renders the mechanical arrangement simpler and easier to use, when considering that the gummed printing roll must be freed for each paper change. The lifting of the gummed printing roll 6, pushed to teeth 15, provides for easy pulling out or pushing out of the printing roll thereby overcoming all possible frictions.

While there has been shown and disclosed what is considered to be the preferred embodiments of the invention, it will be obvious to those skilled in the art that various changes and modifications may be made without departing from the scope of the invention.

The invention claimed is:

1. A printing roll release mechanism for a printing roll provided in a thermal printer comprising:

a holder (1) for holding said printing roll (6);

said holder being provided with upper openings (2);

each of said upper openings providing for an outline having an inside part comprising a first semi-circular cavity (7) provided with two terminal ends, a slanting part (8) extending from a first terminal end of said semi-circular cavity toward said upper opening (2) and a first vertical part (9) extending from said slanting part (8) and a second vertical part (10) extending from the other terminal end of said semi-circular cavity;

a locking lever (13) including a second or another set of semi-circular cavities (16) provided with locking teeth (14) and freeing teeth (15) to cooperate with the printing roll (6) for locking and releasing the printing roll from said thermal printer, and the first-mentioned semi-circular cavities (7) cooperating with the second-mentioned semi-circular cavities (16), and said locking teeth (14) fastening the printing roll (6) in its working position; and a lifting projection part (19) coupled with said lever (13) for rotating said lever (13) around a pin (12) to free the printing roll (6) from said holder (1) so that the printing roll (6) can be lifted from its seat, and the freeing teeth (15) push the ferrules (3) and the printing roll (6) along the slanting parts (8) of the openings (2).

2. The printing roll release mechanism according to claim 1, wherein the upper openings (2) are spaced and oppositely disposed.

3. The printing roll mechanism according to claim 1, wherein said slanting part (8) and said vertical part (9) form an obtuse angle therebetween to permit said ferrule to slide out of said semi-circular cavity (7).

4. The printing roll mechanism according to claim 3 wherein the printing roll is carried on a shaft (5) having a longitudinal axis and is substantially perpendicular to said vertical part (9) when said shaft (5) is seated in its seat and shaft (5) is received in the openings (2).

5. The printing roll mechanism according to claim 1, wherein said second vertical part (10) extends from said second terminal end of said first-mentioned semi-circular cavity (7) and is substantially parallel to said first vertical part (9) and together form a guideway for said ferrule (3).

6. The printing roll mechanism according to claim 5, wherein said slanting part (8) and said first vertical part (9) forms one side of said guideway for said ferrule (3) and said second vertical part (10) forms the other side of said guideway.

7. The printing roll mechanism according to claim 1, wherein said locking teeth (14) and (15) together with said second-mentioned semi-circular cavity (16) form a pathway therebetween for said ferrule (3).

8. The printing roll release mechanism according to claim 7, wherein each said freeing tooth (15) is provided on the innermost part of said lever (13) with an inside surface (17) having an outline which extends from one end of said semi-circular cavity (16) to its other end (18) proximate to said locking tooth (14) and is a partial continuation of said semi-circular cavity.

9. The printing roll release mechanism according to claim 1, wherein the other end of said semi-circular cavity (16) is provided with a portion defining an outline projection (18) and said locking tooth (14) which extends in a circular direction as a continuation of the semi-circular cavity (16) with said locking tooth (14) and said outline projection (18) forming a substantially S-shaped curvature such that a substantially central area where the S-shaped portion changes direction, portion (18) acts as a part of locking member together with said locking tooth (14) to lock shaft (5) to said release and locking lever (13).

10. The printing roll release mechanism according to claim 1, wherein said projection part (19) is positioned at an extremity of said level (13).

11. The printing roll release mechanism according to claim 1, wherein the printing roll is a gummed printing roll.

12. The printing roll mechanism according to class 11, wherein said locking lever includes a circular arm and two extension members each provided with one of said semi-circular cavities (16).

13. The printing roll mechanism according to claim 12, wherein said extension members are longitudinally spaced from each other and are parallel to each other.

14. The printing roll mechanism according to claim 12, wherein said projection part (19) is connected with one of said extension members.

15. A thermal printer including a printing head and comprising:

a printing roll release mechanism for releasing the printing roll (6) from the printing head of the thermal printer;

a holder (1) for the printing head provided with upper openings (2);

each said upper opening providing an outline having an inside part consisting of a semi-circular cavity (7);

a slanting parts (8) slanting toward the upper opening (2) and a vertical part (9);

the thermal printer additionally comprising a lever (13) provided with locking teeth (14) and freeing or unlocking teeth (15) for the printing roll (6), wherein the printing roll (6) is fastened in its working position opposite to the semi-circular cavities (7) of the openings (2) of the holder (I) and with semi-circular cavities (16) of the lever (13) and with the locking teeth (14) fastening or locking the printing roll (6) in the working position; and lifting means including a projecting part (19) coupled with the level (13) for rotation of said lever (13) around a pin (12) for a freeing of the printing roll (6) lifted from its own seat by means of the freeing teeth (15) that push the ferrules (3) of the shaft (5) of the printing roll (6) along the slanting parts (8) of the openings (2) of the holder (1).

16. The thermal printer according to claim 15, wherein the printing roll is a gummed printing roll.

17. The thermal printer according to claim 15, where same semi-circular cavity (7) is provided with another vertical part (10) substantially parallel to said first-mentioned vertical part.

* * * * *